US006616405B2

(12) United States Patent
Torii et al.

(10) Patent No.: US 6,616,405 B2
(45) Date of Patent: Sep. 9, 2003

(54) COOLING STRUCTURE FOR A GAS TURBINE

(75) Inventors: Shunsuke Torii, Hyogo (JP); Jun Kubota, Hyogo (JP); Yasuoki Tomita, Hyogo (JP); Hiroyuki Aoki, Hyogo (JP); Masamitsu Kuwabara, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/998,668

(22) Filed: Dec. 3, 2001

(65) Prior Publication Data

US 2002/0090295 A1 Jul. 11, 2002

(30) Foreign Application Priority Data

Jan. 9, 2001 (JP) ..... 2001-001951

(51) Int. Cl.[7] ..... F01D 9/00
(52) U.S. Cl. ..... 415/914; 416/97 R; 416/193 A
(58) Field of Search ..... 415/115, 116, 415/914; 416/193 A, 95, 96 R, 97 R

(56) References Cited

U.S. PATENT DOCUMENTS 4,040,767 A * 8/1977 Dierberger et al. ..... 415/115
4,653,983 A * 3/1987 Vehr ..... 416/97 R
4,808,785 A * 2/1989 Vertz et al. ..... 219/69 M
4,946,346 A * 8/1990 Ito ..... 415/115
4,992,025 A * 2/1991 Stroud et al. ..... 416/97 R
5,382,135 A * 1/1995 Green ..... 416/97 R
5,584,651 A * 12/1996 Pietraszkiewicz et al. .. 415/115
5,683,600 A * 11/1997 Kelley et al. ..... 219/121.71
6,196,792 B1 * 3/2001 Lee et al. ..... 415/116
6,210,111 B1 * 4/2001 Liang ..... 416/97 R
6,307,175 B1 * 10/2001 Blochlinger et al. ... 219/121.71
6,341,939 B1 * 1/2002 Lee ..... 416/97 R
6,416,284 B1 * 7/2002 Demers et al. ..... 416/97 R
6,420,677 B1 * 7/2002 Emer et al. ..... 219/121.71

FOREIGN PATENT DOCUMENTS

| | | |
|---|---|---|
| JP | 7-305638 | 11/1995 |
| JP | 11-270353 | 10/1999 |
| JP | 2000-230401 | 8/2000 |
| JP | 2000-257447 | 9/2000 |

* cited by examiner

*Primary Examiner*—Edward K. Look
*Assistant Examiner*—James M McAleenan
(74) *Attorney, Agent, or Firm*—Oblon, Spivak, McClelland, Maier & Neustadt, P.C.

(57) ABSTRACT

In a cooling structure for a gas turbine, cooling air diffusion holes are formed from inner surface to outer surface of a platform so as to open from high pressure side blade surface of a moving blade offset in a direction toward low pressure side blade surface of adjacent moving blade confronting the high pressure side blade surface, in a direction of primary flow.

9 Claims, 11 Drawing Sheets

SECTIONAL VIEW ALONG LINE A-A

SECTIONAL VIEW ALONG LINE D-D

COOLING STRUCTURE FOR A GAS TURBINE

FIELD OF THE INVENTION

The present invention relates to a cooling structure for a gas turbine. More particularly, this invention relates to a cooling structure for a gas turbine improved in the film cooling structure for high temperature members such as platform of turbine moving blade.

BACKGROUND OF THE INVENTION

To enhance the heat efficiency of gas turbine used in generator or the like, it is effective to raise the temperature of the operating high temperature gas at the turbine inlet, but the turbine inlet temperature cannot be merely raised because the heat resisting performance of turbine materials exposed to high temperature gas (hereinafter called high temperature members), including the turbine moving blades and turbine stationary blades, is specified by the physical properties of the materials.

Accordingly, it has been attempted to enhance the heat efficiency within the range of heat resisting performance of high temperature members by raising the turbine inlet temperature while cooling the turbine high temperature members by a cooling medium such as cooling air.

Cooling methods of high temperature members include the convection heat transfer type of passing cooling air into the high temperature members, and keeping the surface temperature of high temperature members lower than the temperature of high temperature gas by heat transfer from high temperature members to cooling air, the protective film type of forming a compressed air film of low temperature on the surface of high temperature members, and suppressing heat transfer from the high temperature gas to the high temperature member surface, and the cooling type combining these two types.

The convection heat transfer type includes convection cooling and blow (collision jet) cooling, and the protective film type includes film cooling and exudation cooling, and among them, in particular, the exudation cooling is most effective for cooling the high temperature members. However, it is difficult to process the porous material used in exudation cooling, and uniform exudation is not expected when pressure distribution is not uniform, and therefore among the practical methods, the cooling structure by film cooling is most effective for cooling high temperature members, and in the gas turbine of high heat efficiency, the cooling structure combining the convection cooling and film cooling is widely employed.

In the cooling structure by film cooling, meanwhile, it is required to form diffusion holes for blowing out cooling air, by discharge processing or the like, from the inner side of the high temperature members or the back side of the surface exposed to high temperature gas, to the surface exposed to the high temperature gas. Hitherto, the diffusion holes were formed so as to open toward the direction of the primary flow of high temperature gas flowing along the high temperature members.

However, the flow of high temperature gas is disturbed to form complicated secondary flow advancing in a direction different from the primary flow due to various factors, such as sealing air leaking between the platform of turbine moving blade and inner shroud of the turbine stationary blade, air leaking between the split ring which is the peripheral wall disposed opposite to the tip side (the leading end in the radial direction) of the turbine moving blade and the outer shroud of the turbine stationary blade, and a pressure difference after collision against the passage wall such as blade, split ring, platform, and shroud.

Accordingly, the cooling air blown out along the primary flow direction is scattered by the secondary flow, and the cooling effect on the high temperature members cannot be exhibited sufficiently.

SUMMARY OF THE INVENTION

It is an object of the present invention to provide a cooling structure for a gas turbine enhanced in the cooling effect of film cooling as compared to the conventional art.

The cooling structure for a gas turbine according to one aspect of the present invention is a cooling structure for a gas turbine forming multiple diffusion holes in high temperature members of gas turbine for blowing cooling medium to outer surface of high temperature members of gas turbine for film cooling of the high temperature members, in which the diffusion holes are formed so as to open in a direction nearly coinciding with the secondary flow direction of high temperature gas flowing on the outer surface of the high temperature members.

According to the above-mentioned cooling structure, since the cooling medium blown out from the diffusion holes of the high temperature members is blown out in a direction nearly coinciding with the secondary flow direction of the high temperature gas flowing on the outer surface of the high temperature members, the blown-out cooling medium is not disturbed by the secondary flow of the high temperature gas, and an air film as protective layer is formed on the surface of the high temperature members, so that a desired cooling effect may be given to the high temperature members.

High temperature members of gas turbine include, for example, turbine moving blade, turbine stationary blade, platform of turbine moving blade, inner and outer shrouds of turbine stationary blade, and turbine combustor.

As the cooling medium, cooling air may be used, and the cooling air may be obtained, for example, by extracting part of the air supplied in the compressor of the gas turbine, and cooling the extracted compressed air by a cooler.

The secondary flow is caused by leak of sealing air, or due to pressure difference in the passage after high temperature gas collides against the blade, and the flow direction may be determined by flow analysis or experiment using actual equipment. The direction nearly coinciding with the secondary flow direction is in a range of about ±20 degrees of the secondary flow direction, preferably in a rage of ±10 degrees, and most preferably in a range of ±5 degrees.

Other objects and features of this invention will become apparent from the following description with reference to the accompanying drawings.

DESCRIPTION OF THE PREFERRED EMBODIMENTS

Embodiments of cooling structure for a gas turbine according to the invention are specifically described while referring to the accompanying drawings. It must be noted, however, that the invention is not limited to the illustrated embodiments alone.

Figure 1:
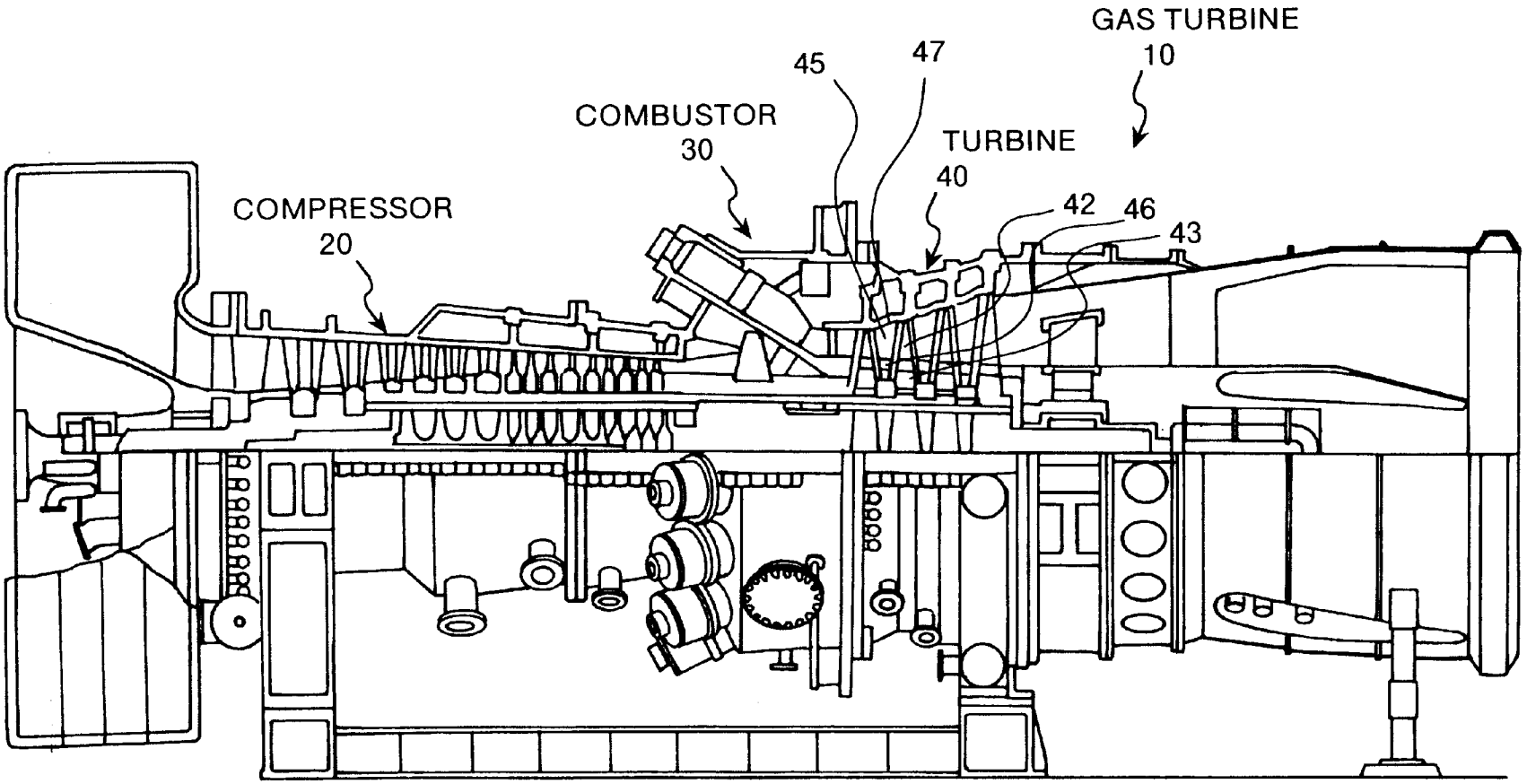
FIG. 1 is a semi-sectional view showing an entire gas turbine according to cooling structure in a first embodiment of the invention.

FIG. 1 is a partial longitudinal sectional view of a gas turbine 10 for explaining the cooling structure for a gas turbine in a first embodiment of the invention. The gas turbine 10 comprises a compressor 20 for compressing supplied air, a combustor 30 for injecting fuel to the compressed air from the compressor 20 and generating high temperature combustion gas (high temperature gas), and a turbine 40 for generating a rotary driving force by the high temperature gas generated in the combustor 30. The turbine 10 includes a cooler, not shown, for extracting part of compressed air from the compressor 20, and sending out the extracted compressed air to a moving blade 42, a stationary blade 45, and a platform 43 of the turbine 40, and also to an inner shroud 46 and an outer shroud 47 of the stationary blade 45.

Figure 2A:
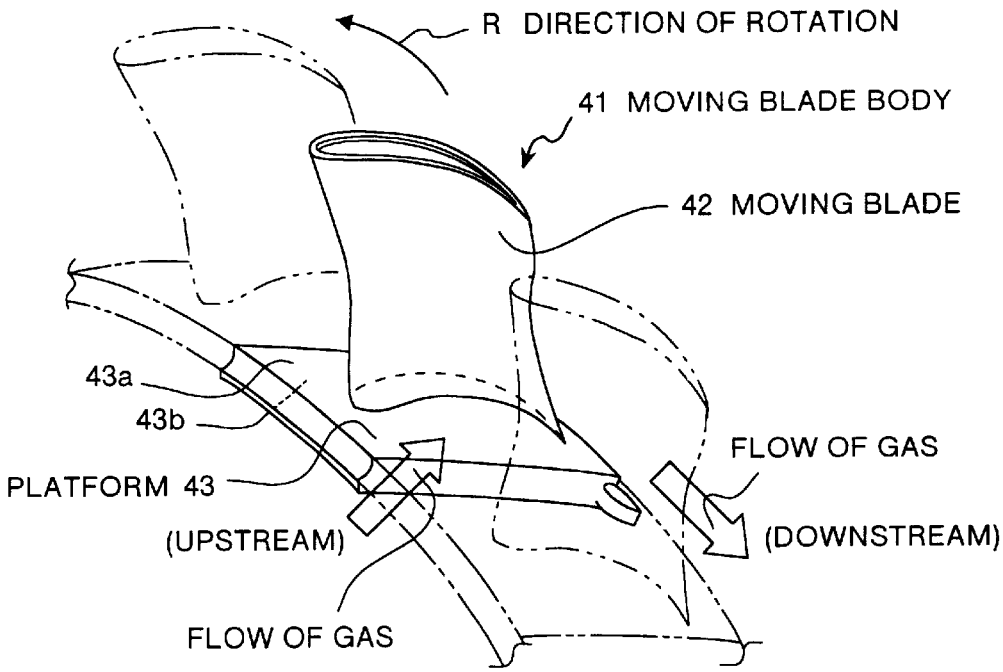
FIG. 2A and FIG. 2B are diagrams showing flow of high temperature gas in platform in the first embodiment of the invention.

A moving blade body 41 of the turbine 40, as shown in FIG. 2A, is composed of the moving blade 42 and the platform 43 which is coupled to a rotor not shown, and the direction of primary flow V1 of high temperature gas in the moving blade body 41 is the direction of blank arrow shown in FIG. 2A.

Figure 2B:
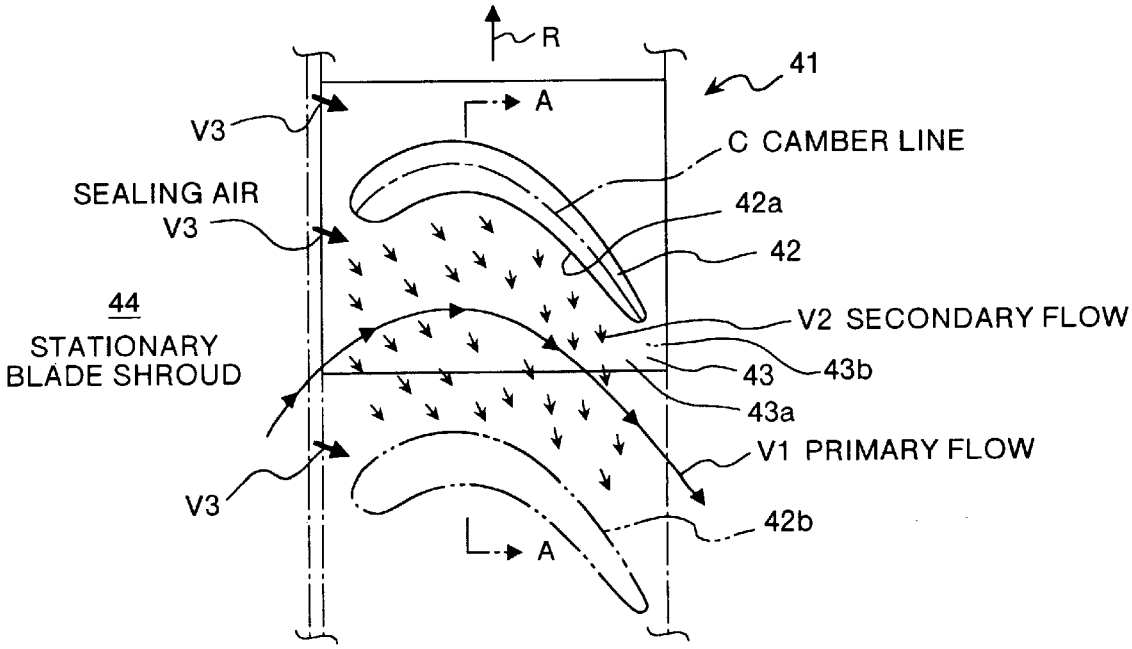

FIG. 2B is a sectional view along the surface including the outer surface of the platform 43 in FIG. 2A, and the direction of primary flow V1 of high temperature gas shown in FIG. 2A is more specifically a direction nearly parallel to the camber line C of the moving blade 42.

In the platform 43, in order to protect from high temperature gas, diffusion holes for film cooling are formed, and the diffusion holes for film cooling were, hitherto, formed along the direction of primary flow V1, that is, in a direction parallel to the camber line C, so as to incline and penetrate at the outer surface 43*a* side of flow of high temperature gas from the back side (inner side) 43*b* of the platform 43.

Thus, by opening the diffusion holes in the direction of primary flow V1 of high temperature gas, the cooling air blown out from the diffusion holes to the outer surface 43*a* of the platform 43 runs along the flow direction (primary flow direction V1) of high temperature gas, and hence the cooling air is not disturbed in its flow direction by the flow of high temperature gas, and therefore it has been considered that the outer surface 43*a* of the platform 43 is protected from burning by high temperature gas.

In the gas turbine 10, the diffusion holes are formed along the direction of secondary flow V2 of high temperature gas, from the inner surface 43*b* to outer surface 43*a* of the platform 43. More specifically, in the direction of primary flow V1, that is, in a direction parallel to the camber line C, they are formed from the inner surface 43*b* to outer surface 43*a* of the platform 43 so as to open offset in a direction toward the low pressure side blade surface 42*b* of the adjacent moving blade 42 confronting the high pressure side blade surface 42*a* from the high pressure side blade surface 42*a* of the moving blade 43.

The mechanism for the formation of secondary flow of high temperature gas is explained on the basis of the results of studies by the present inventors.

First, on the platform 43, sealing air (purge air) V3 escapes from a gap to the inner shroud 44 of the stationary blade at the upstream side of high temperature gas, and the relative flow direction of the sealing air V3 to the moving blade body 41 rotating in the direction of arrow R, as shown in FIG. 2B, is a direction offset from the camber line C toward the low pressure side blade surface 42*b* of the adjacent moving blade 42 confronting the high pressure side blade surface 42*a* from the high pressure side blade surface 42*a* of the moving blade 42. By the flow of sealing air V3, the flow direction of primary flow V1 of high temperature gas is changed, and the changed flow is the secondary flow V2.

Figure 3A:
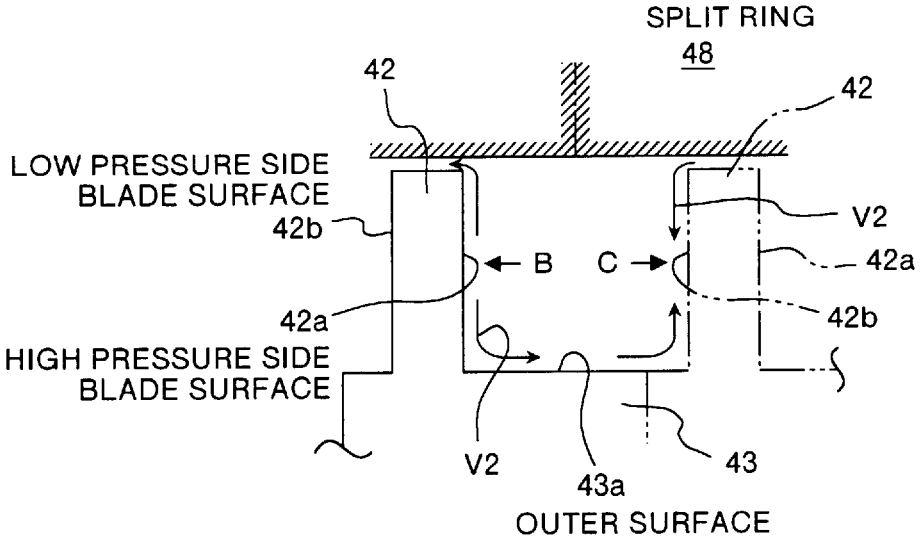
FIG. 3A to FIG. 3C explain secondary flow at the blade surface of the moving blade.

The secondary flow V2 is not produced by the sealing air V3 only. That is, in FIG. 3A which is a sectional view taken along line A—A in FIG. 2B, the high temperature gas flowing into the moving blade body 41 collides against the high pressure side blade surface 42*a* of the moving blade 42, and the colliding high temperature gas produces a flow along a split ring 48 disposed at the tip side (outside) of the moving blade 42 along the high pressure side blade surface 42*a*, and a flow toward the platform 43.

The flow toward the split ring 48 flows into the low pressure side blade surface 42*b* of the moving blade 42 from a gap between the outer end of the moving blade 42 to the split ring 48. On the other hand, the flow toward the platform 43 side flows on the platform 43 from the high pressure side blade surface 42*a* of the moving blade 42 toward the low pressure side blade surface 42*b* of the adjacent moving blade 42 confronting the high pressure side blade surface 42*a,* and climbs up in the outside direction along the low pressure side blade surface 42*b* of the adjacent moving blade 42.

Figure 3B:
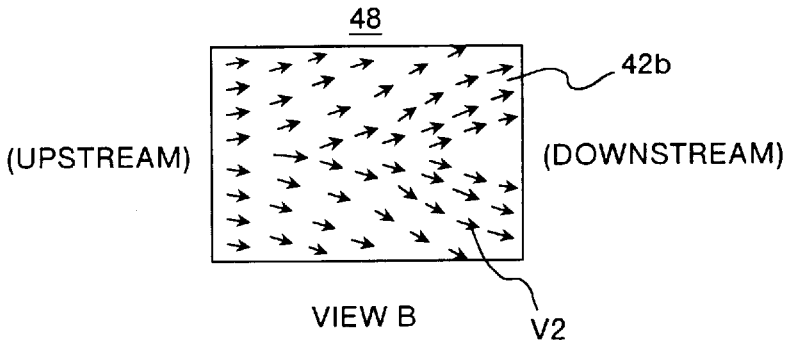
Figure 3C:
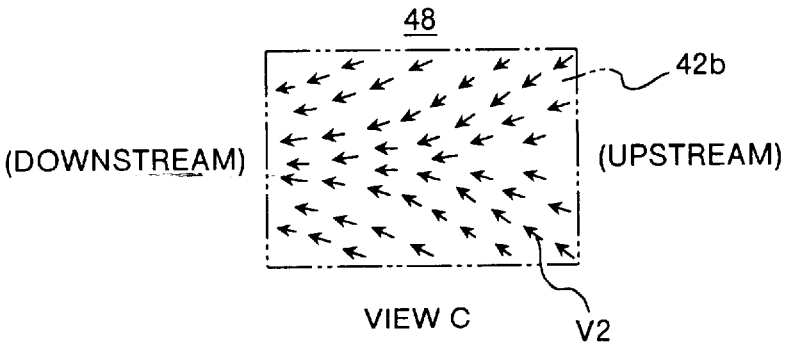

That is, the flow of high temperature gas in the high pressure side blade surface 42*a* of each moving blade 42 is as indicated by the arrow in FIG. 3B, and the flow of high temperature gas in the low pressure side blade surface 42*b* is as indicated by the arrow in FIG. 3C. The flow of high temperature gas on the platform 43 is the secondary flow V2 in FIG. 2B. Thus, along the direction of secondary flow V2 on the platform 43, a mode of forming diffusion holes 43*c* is shown in FIG. 4, FIG. 5A, and FIG. 5B.

Figure 4:
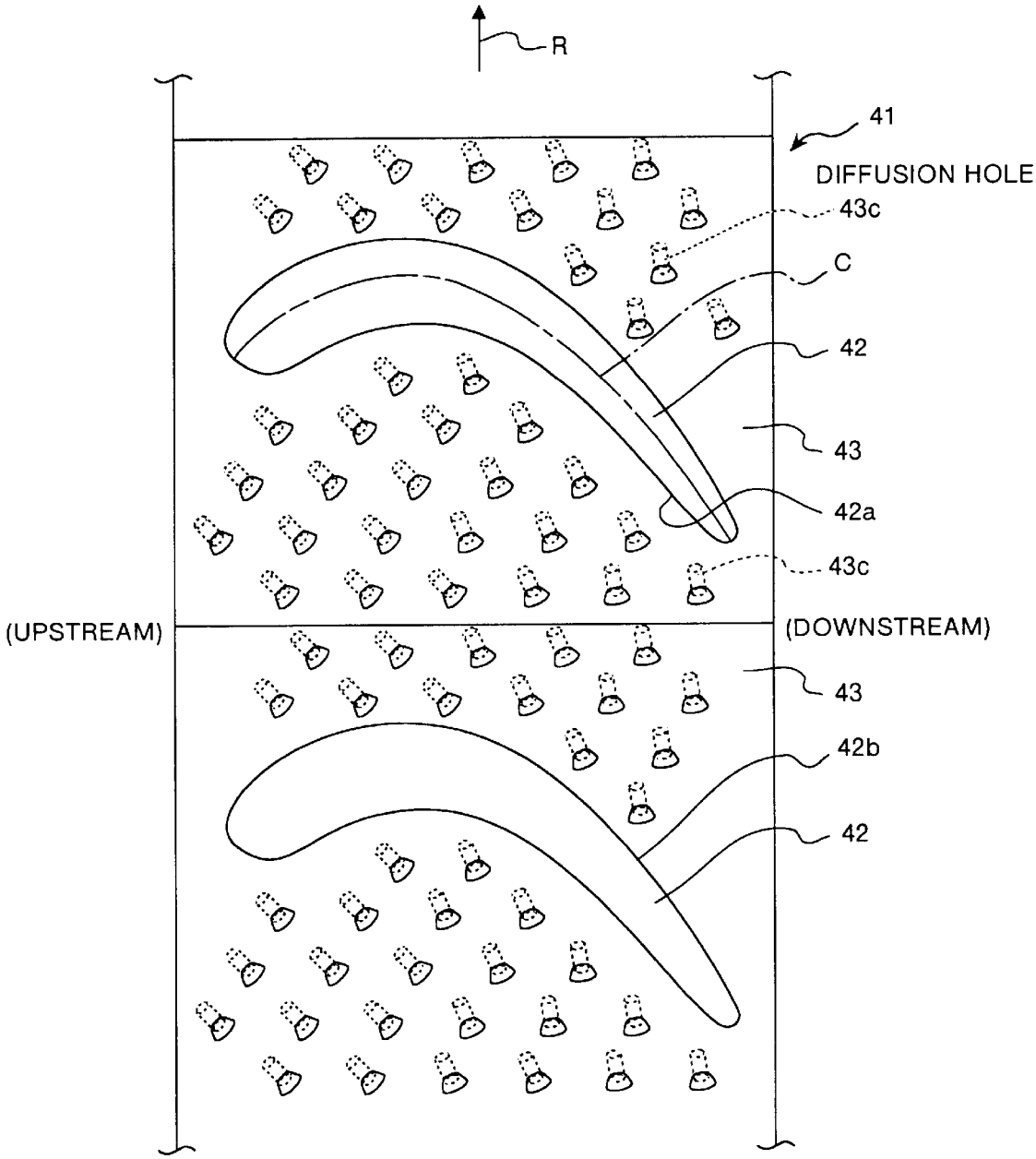
FIG. 4 is a diagram showing platform forming diffusion holes of cooling air in the first embodiment.
Figure 5A:
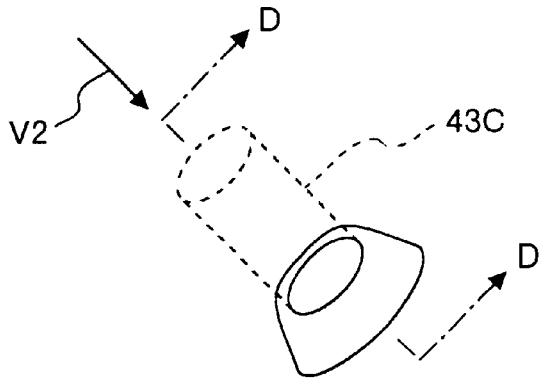
FIG. 5A and FIG. 5B are diagrams showing the detail of the air diffusion holes.
Figure 5B:
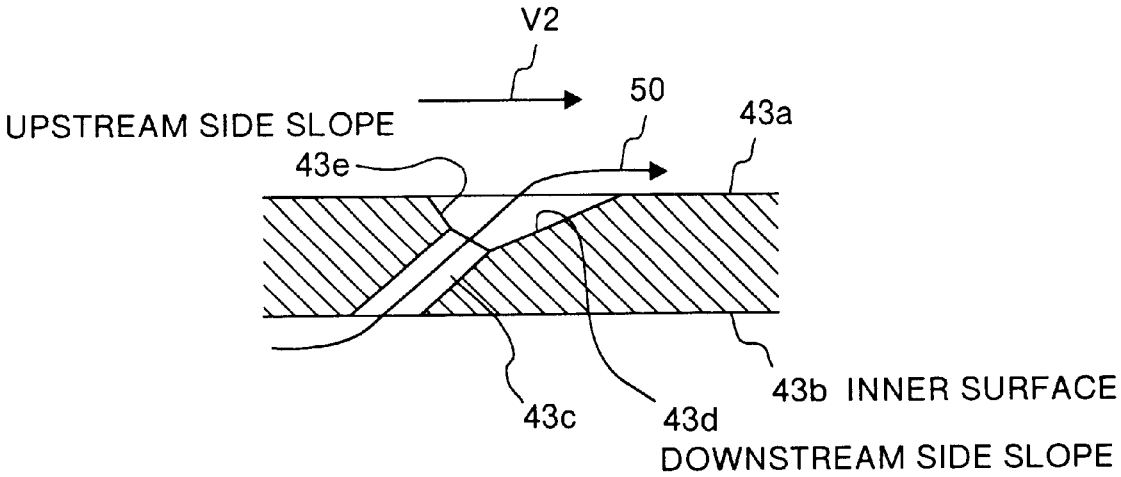

As shown in FIG. 4, FIG. 5A, and FIG. 5B, in order to open the diffusion holes 43*c* offset in a direction from the high pressure side blade surface 42*a* of the moving blade 42 toward the low pressure side blade surface 42*b* of the adjacent moving blade 42 confronting the high pressure side blade surface 42*a,* in a direction parallel to the camber line C, they are disposed from the inner surface 43*b* (see FIG. 5B) to the outer surface 43*a* (see FIG. 5B) of the platform 43, and therefore the cooling air blow out from the outer surface 43*a* of the platform 43 runs along the secondary flow V2 of high temperature gas on the platform 43, and the cooling air is not disturbed by the secondary flow V2 of high temperature gas, forming a cooling air film on the outer surface 43*a,* so that a desired cooling effect on the platform 43 is obtained.

Diffusion holes 43*c* shown in FIG. 4 correspond to the secondary flow V2 shown in FIG. 2B, and the direction of the diffusion holes in the cooling structure for a gas turbine of the invention is not always limited to the configuration shown in FIG. 4, but may be free as far as corresponding to the direction of secondary flow V2 determined by flow analysis or experiment.

FIG. 5A shows diffusion holes 43*c* formed on the outer surface 43*a* of the platform 43, and FIG. 5B is a sectional view along line D—D in FIG. 5A. As shown in FIG. 5A, the opening end on the outer surface 43*a* of the platform 43 of the diffusion holes 43*c* is shaped like a funnel with the downstream side slope 43*d* of the secondary flow V2 less steeply than the upstream side slope 43*e*, and according to this structure, since the cooling air (50 in FIG. 5B) blown out from the diffusion holes 43*c* flows along the downstream side slope 43*d* less steeply than the upstream side of the secondary flow V2, at this opening end, it flows more smoothly along the secondary flow V2 of high temperature gas, and the reliability of formation of cooling air film on the outer surface 43*a* of the platform 43 is enhanced, and the cooling effect on the platform 43 is further improved, but the cooling structure for the gas turbine of the invention is not always limited to formation of such opening end.

Figure 6A:
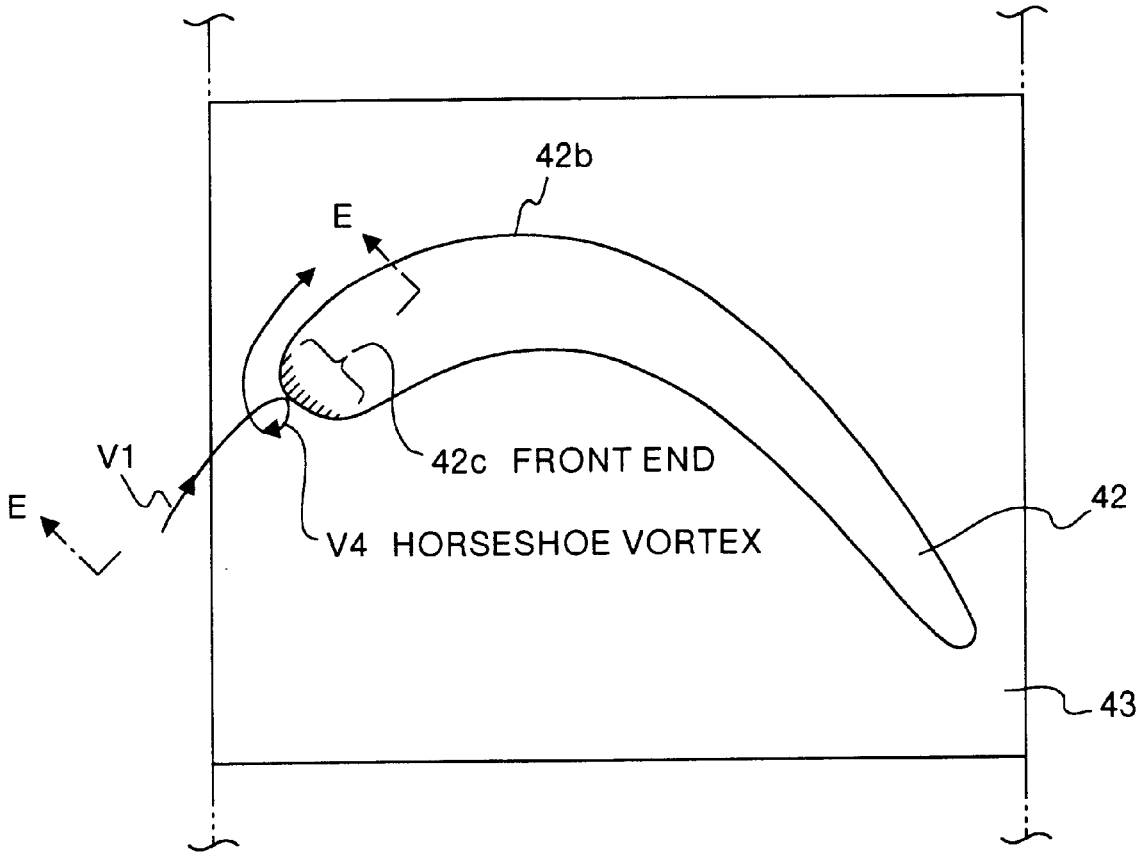
FIG. 6A and FIG. 6B are explanatory diagrams of horseshoe vortex flow in platform in a second embodiment of the invention.
Figure 6B:
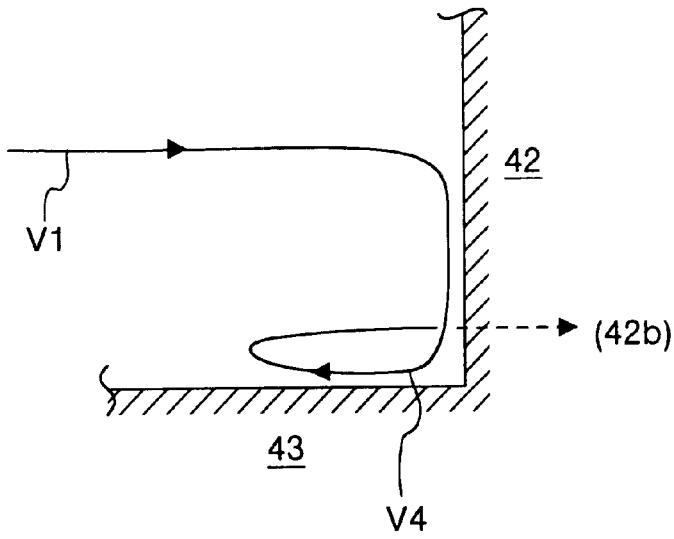
Figure 7:
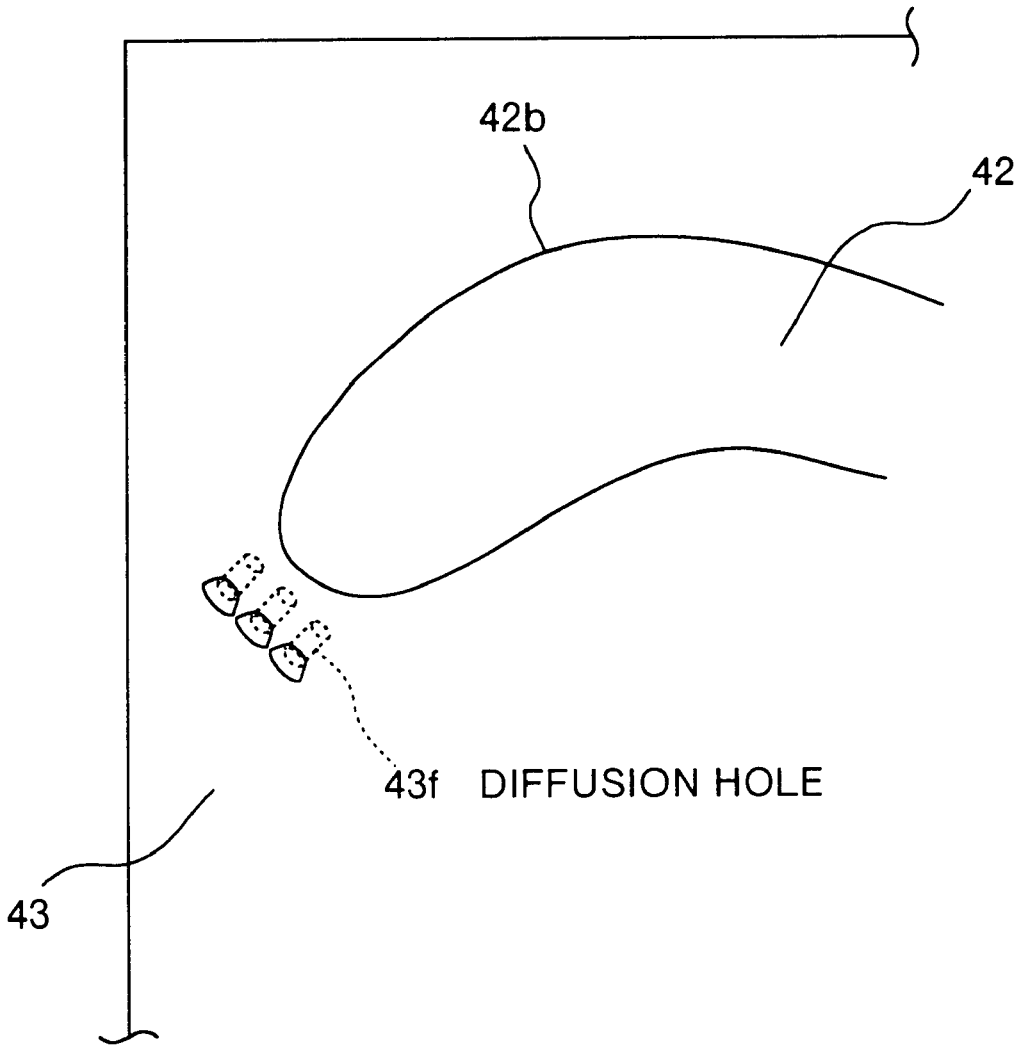
FIG. 7 is a diagram showing platform forming diffusion holes of cooling air in the second embodiment.

FIG. 6A and FIG. 6B are diagrams showing flow of high temperature gas near the front end (high pressure gas upstream side end of moving blade 42) 42*c* of the moving blade 42 for explaining the cooling structure for a gas turbine in a second embodiment of the invention, and FIG. 7 is a diagram showing the cooling structure of platform 43 of gas turbine in the second embodiment.

According to the first embodiment, on the platform 43, the primary flow V1 of high temperature gas runs nearly parallel to the camber line C of the moving blade 42. At the front end 42*c* of the moving blade 42, as shown in a sectional view inn FIG. 6B, horseshoe vortex V4 is formed as secondary flow V2 of high temperature gas.

This horseshoe vortex V4 is formed when part of the primary flow V1 of high temperature gas flowing into the moving blade 42 collides against the front end 42*c* of the moving blade 42, moves into the root portion direction (direction of platform 43) of the moving blade 42 along the moving blade 42*c,* runs on the platform 43 in a direction departing from the moving blade 42, and gets into the direction of the low pressure moving blade surface 42*b* of the moving blade 42.

According to the cooling structure of the gas turbine in the second embodiment, diffusion holes 43*f* of cooling air of the platform 43 near the front end 42*c* of the turbine moving blade are formed from the inner surface 43*b* (see FIG. 5B) to the outer surface 43*a* (see FIG. 5B) of the platform 43 so as to open along the flow direction of the horseshoe vortex V4 flowing in the direction departing from the front end 42*c* of the moving blade 42 at the platform 43.

Since the cooling air diffusion holes 43*f* are thus formed, the cooling air blown out from the outer surface 43*a* of the platform 43 runs along the horseshoe vortex V4 of high temperature gas on the platform 43, and the cooling air is not disturbed by the horseshoe vortex V4 of high temperature gas, thereby forming a cooling air film on the outer surface 43*a,* so that a desired cooling effect on the platform 43 near the front end 42*c* of the moving blade 42 may be obtained.

At the opening end of the diffusion holes 43*f* in the second embodiment, the same as in the case of the diffusion holes 43*c* in the first embodiment, the downstream side slope of the horseshoe vortex V4 is preferred to be formed like a funnel of a less steep slope than the upstream side slope. It may be also combined with the first embodiment.

Figure 8:
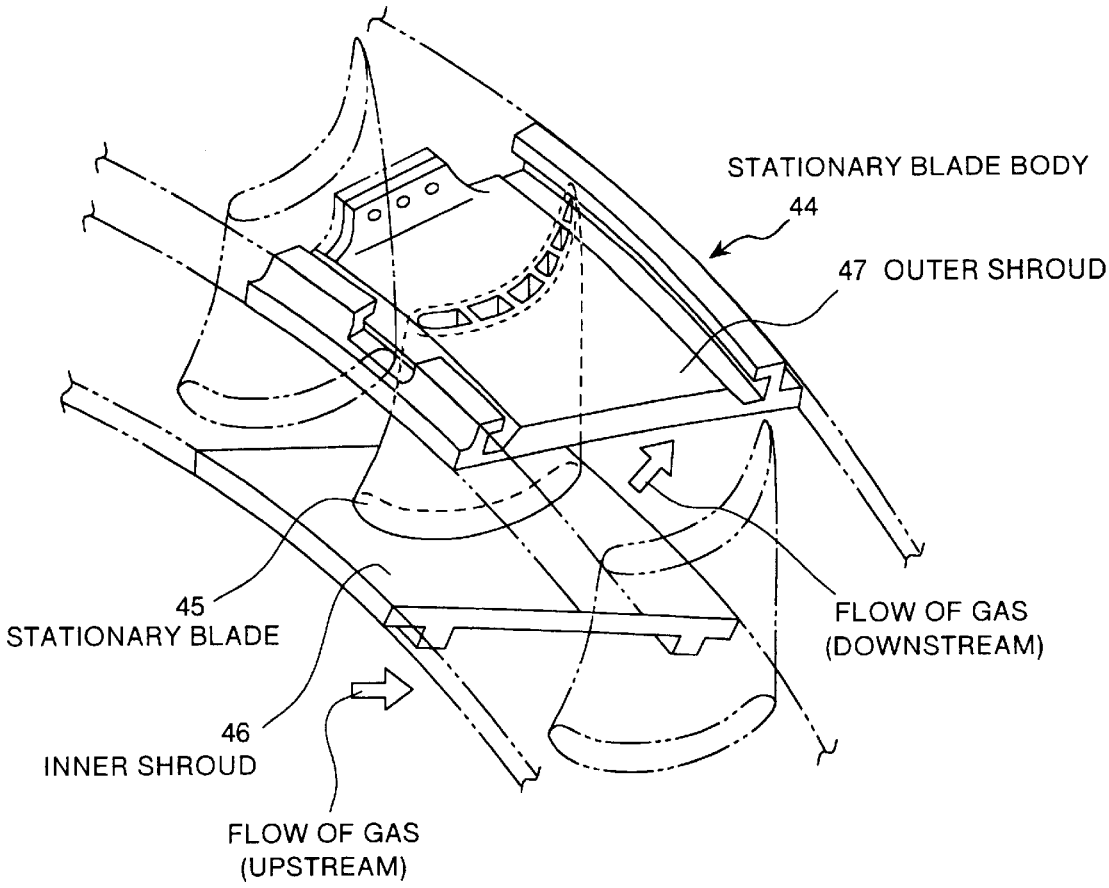
FIG. 8 is a perspective view showing flow of high temperature gas in a shroud of a stationary blade in the second embodiment of the invention.
Figure 9A:
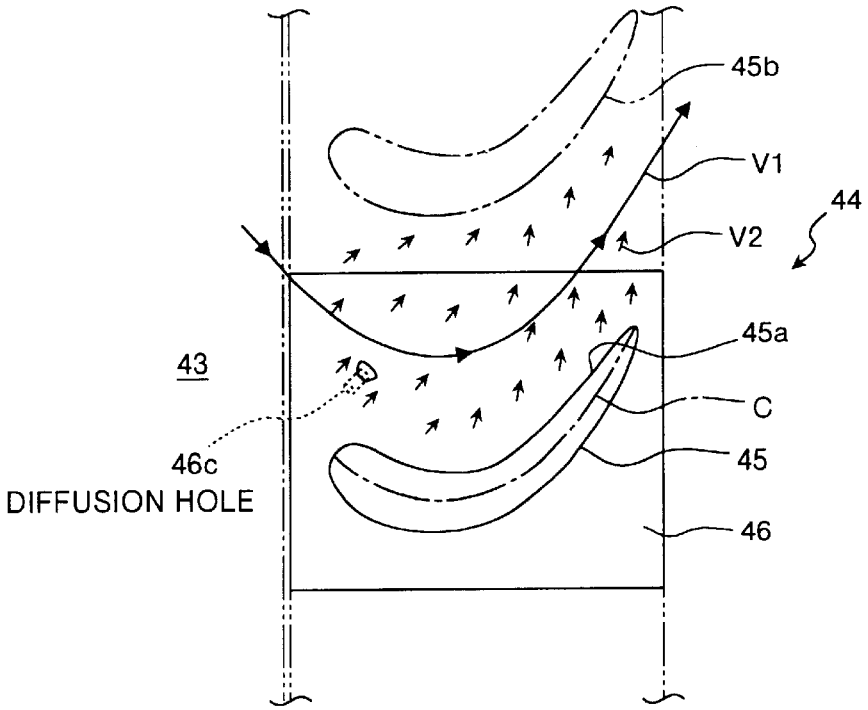
FIG. 9A and FIG. 9B are diagrams showing a shroud forming diffusion holes of cooling air in a third embodiment.
Figure 9B:
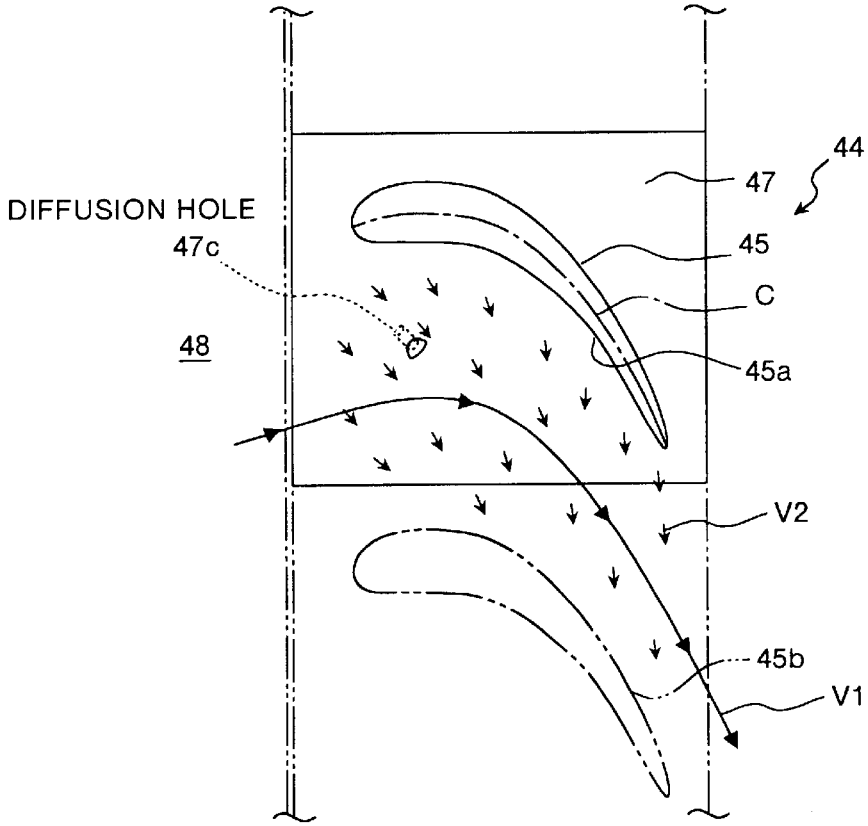

FIG. 8, FIG. 9A, and FIG. 9B are diagrams showing flow of high temperature gas in a stationary blade body 44 for explaining the cooling structure for a gas turbine in a third embodiment of the invention, and FIG. 9A specifically shows cooling air diffusion holes 46*c* in an inner shroud 46 of the stationary blade body 44, and FIG. 9B specifically shows cooling air diffusion holes 47*c* in an outer shroud 47 of the stationary blade body 44.

The stationary blade body 44 of the turbine 40, as shown in FIG. 8, is composed of stationary blade 45, and outer shroud 47 and inner shroud 46 fixed in a casing not shown, and the direction of primary flow V1 of high temperature gas in this stationary blade body 44 is the direction of blank arrow.

FIG. 9A is a sectional view along the side including the surface of the inner shroud 46 in FIG. 8, and FIG. 9B is a sectional view along the side including the surface of the outer shroud 47 in FIG. 8. In these inner and outer shrouds 46, 47, the direction of primary flow V1 of high temperature gas is a direction nearly parallel to the camber liner C of the stationary blade 45 on the surface of the shrouds 46, 47.

On the other hand, in the same manner as the secondary flow V2 caused by the moving blade 42 explained in the first embodiment, on the stationary blade body 44, too, a secondary flow V2 is formed by the stationary blade 45, and the direction of the second flow V2 is, same as in the first embodiment, in the direction of primary flow Vi, that is, in a direction parallel to the camber line C, offset in a direction from the high pressure side blade surface 45*a* of the stationary blade 45 toward the low pressure side blade surface 45*b* of the adjacent stationary blade 45 confronting the high pressure side blade surface 45*a*.

In the third embodiment, diffusion holes 46*c* of cooling air of the inner shroud 46 and diffusion holes 47*c* of cooling air of the outer shroud 47 are formed, as shown in FIG. 9A and FIG. 9B respectively, so as to open in a direction offset from the high pressure side blade surface 45*a* of the stationary blade 45 toward the low pressure side blade surface 45*b* of the adjacent stationary blade 45, along the direction of secondary flow V2 of high pressure gas, that is, in the direction of primary flow V1 or direction parallel to the camber line C.

The cooling air blown out from thus formed diffusion holes 46*c,* 47*c* runs along the secondary flow V2 of high temperature gas on the inner shroud 46 and outer shroud 47, and the cooling air is not disturbed by the secondary flow V2 of high temperature gas, thereby forming a cooling air film, so that a desired cooling effect is obtained on the inner shroud 46 and outer shroud 47.

In FIG. 9A and FIG. 9B, only one diffusion hole, 46*c,* 47*c* is shown in each shroud 46, 47, but this is only for simplifying the drawing, and actually plural diffusion holes 46*c,* 47*c* are formed along the secondary flow V2 in the entire structure of the shrouds 46, 47.

At the opening ends of the diffusion holes 46*c,* 47*c,* same as in the case of the diffusion holes 43*c* in the first embodiment, the downstream side slope of the secondary flow V2 is preferred to be formed like a funnel of a less steep slope than the upstream side slope. It may be also combined with the first embodiment or the second embodiment.

Figure 10A:
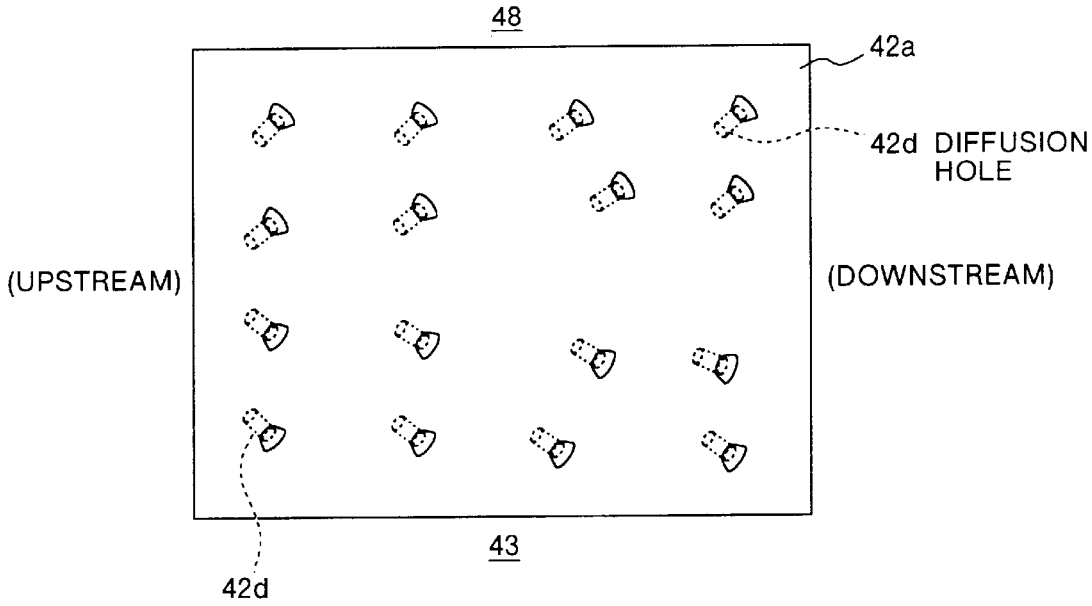
FIG. 10A and FIG. 10B are diagrams showing moving blade forming diffusion holes of cooling air in a fourth embodiment.
Figure 10B:
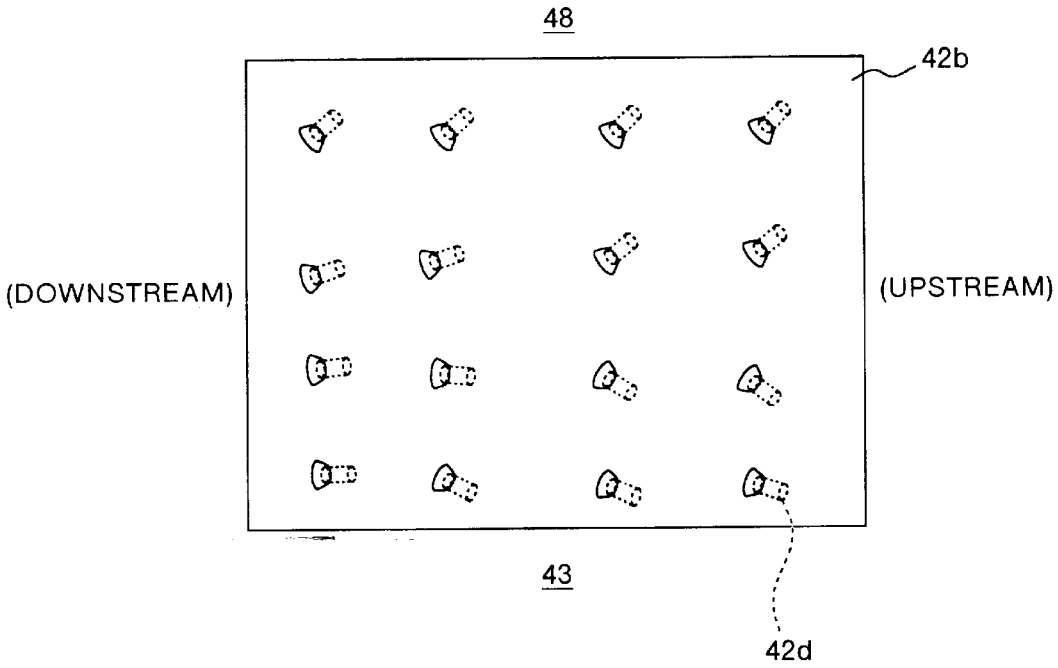

FIG. 10A and FIG. 10B show a fourth embodiment of the invention, relating to cooling air diffusion holes 42*d* in high pressure side blade surface 42*a* and low pressure side blade surface 42*b* of moving blade 42.

The diffusion holes 42*d* are formed so as to open along the secondary flow V2 of high temperature gas at the blade surfaces 42*a,* 42*b* of the moving blade 42 shown in FIG. 3B and FIG. 3C.

The cooling air blown out from thus formed diffusion holes 42*d* runs along the secondary flow V2 of high temperature gas on the high pressure side blade surface 42*a* and low pressure side blade surface 42*b,* and the cooling air is not disturbed by the secondary flow V2 of high temperature gas, thereby forming a cooling air film, so that a desired cooling effect is obtained on the high pressure side blade surface 42*a* and low pressure side blade surface 42*b* of the moving blade 42.

At the opening ends of the diffusion holes 42*d* of the fourth embodiment, same as in the case of the diffusion holes 43*c* in the first embodiment, the downstream side slope of the secondary flow V2 is preferred to be formed like a funnel of a less steep slope than the upstream side slope. It may be also combined with at least one of the first embodiment, the second embodiment and the third embodiment.

Figure 11A:
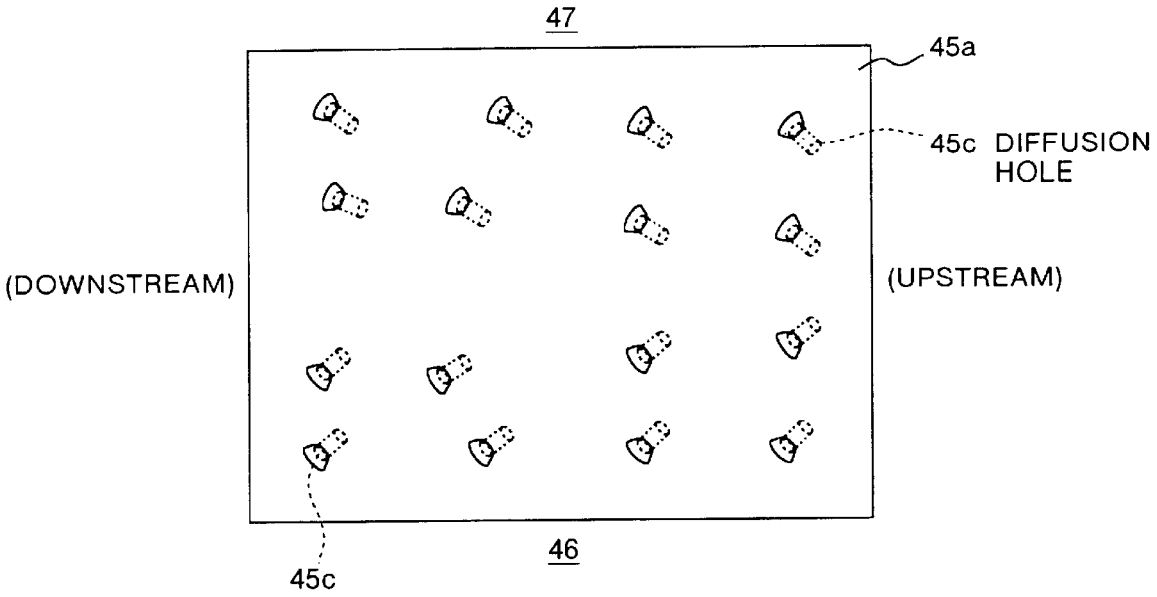
FIG. 11A and FIG. 11B are diagrams showing stationary blade forming diffusion holes of cooling air in a fifth embodiment.
Figure 11B:
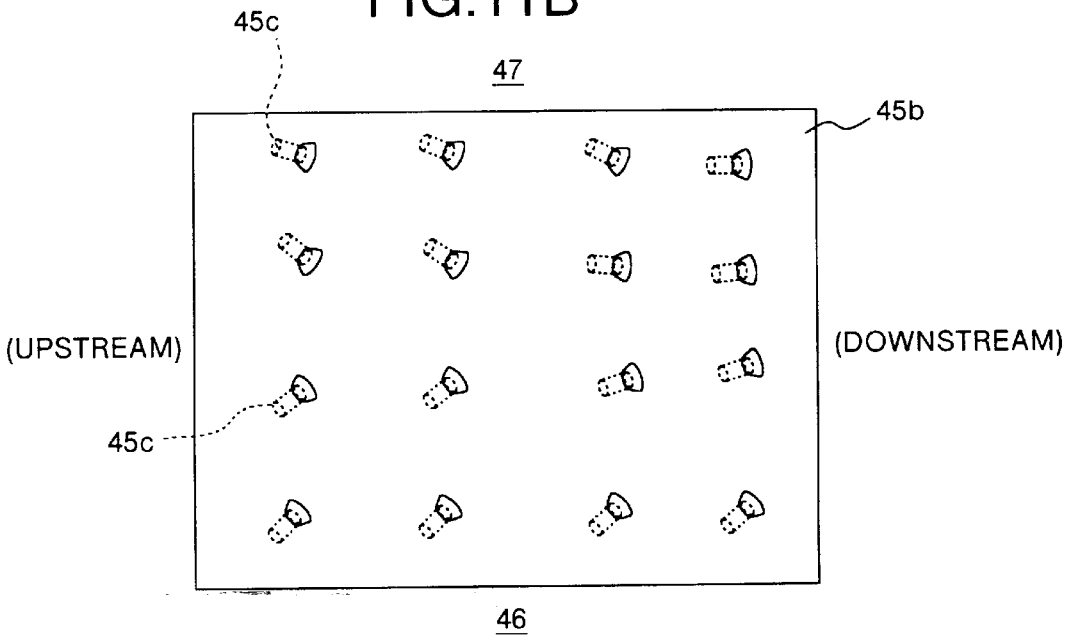

FIG. 11A and FIG. 11B show a fifth embodiment of the invention, relating to cooling air diffusion holes 45*c* in high pressure side blade surface 45*a* and low pressure side blade surface 45*b* of stationary blade 45.

The diffusion holes 45*c* are formed so as to open along the secondary flow V2 of high temperature gas at the high pressure side blade surface 45*a* and low pressure side blade surface 45*b* of the stationary blade 45 as well as the secondary flow V2 of high temperature gas at each blade surface 42*a,* 42*b* of the moving blade 42.

The cooling air blown out from thus formed diffusion holes 45*c* runs along the secondary flow V2 of high temperature gas on the high pressure side blade surface 45*a* and low pressure side blade surface 45*b,* and the cooling air is not disturbed by the secondary flow V2 of high temperature gas, thereby forming a cooling air film, so that a desired cooling effect is obtained on the high pressure side blade surface 45*a* and low pressure side blade surface 45*b* of the stationary blade 45.

At the opening ends of the diffusion holes 45*c* of the fifth embodiment, same as in the case of the diffusion holes 43*c* in the first embodiment, the downstream side slope of the secondary flow V2 is preferred to be formed like a funnel of a less steep slope than the upstream side slope. It may be also combined with at least one of the first to fourth embodiments.

As explained herein, according to the cooling structure for a gas turbine of the invention, since the cooling medium blown out from the diffusion holes of the high temperature members is blown out in a direction nearly coinciding with the secondary flow direction of the high temperature gas flowing on the outer surface of the high temperature members, the blown-out cooling medium is not disturbed by the secondary flow of the high temperature gas, and an air film as protective layer is formed on the surface of the high temperature members, so that a desired cooling effect may be given to the high temperature members. As a result, the durability of the high temperature members of the gas turbine is enhanced, and the reliability of the entire gas turbine is improved.

According to the cooling structure for a gas turbine of the invention, the cooling medium blown out from the outer surface of the platform of the turbine moving blade as high temperature member runs along the secondary flow direction of high temperature gas on the platform, and the cooling medium is not disturbed by the secondary flow of high temperature gas, and an air film is formed on the outer surface, so that a desired cooling effect on the platform of the turbine moving blade is obtained.

According to the cooling structure for a gas turbine of the invention, the cooling medium blown out from the diffusion holes of the platform runs along the secondary flow toward the low pressure side blade surface rather than the primary flow direction of high temperature gas along the camber line of the turbine moving blade, and therefore the cooling medium is not disturbed by the secondary flow of high temperature gas, and an air film is formed on the outer surface, so that a desired cooling effect on the platform of the turbine moving blade is obtained.

According to the cooling structure for a gas turbine of the invention, the cooling medium blown out from the diffusion holes near the front end of the turbine moving blade of the platform runs along the direction of the secondary flow (horseshoe vortex) formed in the vicinity of the front end, and therefore the cooling medium is not disturbed by the secondary flow of high temperature gas, and an air film is formed on the outer surface, so that a desired cooling effect on the platform of the turbine moving blade is obtained.

According to the cooling structure for a gas turbine of the invention, the cooling medium blown out from the diffusion holes of the shroud of the turbine stationary blade as high temperature member runs along the secondary flow of high temperature gas flowing on the outer surface of the shroud, and the cooling medium is not disturbed by the secondary flow of high temperature gas, and an air film is formed on the outer surface, so that a desired cooling effect on the shroud of the turbine stationary blade is obtained. The shroud of the turbine stationary blade includes both outside shroud on the outer periphery and inner shroud on the inner periphery.

According to the cooling structure for a gas turbine of the invention, the cooling medium blown out from the diffusion holes of the shroud runs along the secondary flow toward the low pressure side blade surface of the turbine stationary blade rather than the primary flow direction of high temperature gas along the camber line of the turbine stationary blade, and therefore the cooling medium is not disturbed by the secondary flow of high temperature gas, and an air film is formed on the outer surface, so that a desired cooling effect on the shroud of the turbine stationary blade is obtained.

According to the cooling structure for a gas turbine of the invention, the cooling medium blown out from the diffusion holes near the front end of the turbine stationary blade of the shroud runs along the direction of the secondary flow of horseshoe vortex formed in the vicinity of the front end, and therefore the cooling medium is not disturbed by the secondary flow of high temperature gas, and an air film is formed on the outer surface, so that a desired cooling effect on the shroud of the turbine stationary blade is obtained.

According to the cooling structure for a gas turbine of the invention, the cooling medium blown out from the diffusion holes of the turbine blade as one of high temperature members runs along the secondary flow of high temperature gas flowing on the outer surface of the turbine blade, and the cooling medium is not disturbed by the secondary flow of high temperature gas, and an air film is formed on the outer surface, so that a desired cooling effect on the turbine blade is obtained. The turbine blade includes both stationary blade and moving blade.

According to the cooling structure for a gas turbine of the invention, the cooling medium blown out from the diffusion holes in the upper part of the high pressure side blade surface and in the lower part of the low pressure side blade surface of the turbine blades runs along the direction of the secondary flow formed from the primary flow direction of high temperature gas along the direction parallel to the axis of the turbine toward a direction offset above the blades, and therefore the cooling medium running in this area is not disturbed by the secondary flow of high temperature gas, and an air film is formed on the outer surface, so that a desired cooling effect on this area of the turbine blades is obtained, and moreover the cooling medium blown out from the diffusion holes in the lower part of the high pressure side blade surface and in the upper part of the low pressure side blade surface of the turbine blades runs along the direction of the secondary flow formed from the primary flow direction of high temperature gas along the direction parallel to the axis of the turbine toward a direction offset beneath the blades, and therefore the cooling medium running in this area is not disturbed by the secondary flow of high temperature gas, and an air film is formed on the outer surface, so that a desired cooling effect on this area of the turbine blades is obtained.

According to the cooling structure for a gas turbine of the invention, the cooling medium blown out from the diffusion holes flows along the downstream side slope which is less steep than the upstream side slope of the secondary flow at the opening end, and hence it runs more smoothly along the secondary flow direction of high temperature gas, and the reliability of formation of film on the surface of high temperature members is enhanced, and the cooling effect on the high temperature members may be further enhanced.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A cooling structure for a gas turbine having high temperature members that include a platform of a turbine moving blade, a shroud of a turbine stationary blade, and a turbine blade, and having multiple diffusion holes formed on the high temperature members for film cooling thereof by blowing cooling medium to outer surface of the high temperature members, wherein the platform of the turbine moving blade has first diffusion holes which are formed on a first outer surface of the platform facing a high pressure side of the turbine moving blade and second diffusion holes on a second outer surface of the platform facing a low pressure side of the turbine moving blade so that each hole of the first diffusion holes blows the cooling medium in a direction separating from the high pressure side of the turbine moving blade and each hole of the second diffusion holes blows the cooling medium in a direction heading towards the low pressure side of the turbine moving blade.

2. The cooling structure for a gas turbine according to claim 1, wherein each hole of the first and second diffusion holes has an opening that opens in a direction running from the high pressure side of the blade surface of the turbine moving blade to the low pressure side of the blade surface of adjacent turbine moving blade, and the opening is angled toward the low pressure side of the blade surface of the adjacent turbine moving blade from a curve parallel to the camber line of the turbine moving blade which corresponds to a primary flow direction of high temperature gas.

3. The cooling structure for a gas turbine according to claim 1, wherein the platform has diffusion holes near the front end of the turbine moving blade, and each of the diffusion holes has an opening that opens in an opposite direction to the front end which corresponds to a flow direction of a horseshoe vortex included in a secondary flow of high temperature gas.

4. The cooling structure for a gas turbine according to claim 1, wherein the shroud of the turbine stationary blade has diffusion holes, each of the diffusion holes has an opening that opens in a direction running from a high pressure side of the blade surface of the turbine stationary blade to the low pressure side of the blade surface of an adjacent turbine stationary blade, and the opening is angled toward the low pressure side of the blade surface of the adjacent turbine moving blade from a curve parallel to the camber line of the turbine stationary blade which corresponds to a primary flow direction of high temperature gas.

5. The cooling structure for a gas turbine according to claim 1, wherein the shroud of the turbine stationary blade has diffusion holes near the front end of the turbine stationary blade each of the diffusion holes has an opening that opens in an opposite direction to the front end which corresponds to a flow direction of a horseshoe vortex included in a secondary flow of high temperature gas.

6. The cooling structure for a gas turbine according to claim 1, wherein the diffusion holes in the upper part of the high pressure side of the blade surface and in the lower part of the low pressure side of the blade surface of the turbine blades are formed so as to open offset above the blades from the primary flow direction of high temperature gas along the axial direction of the turbine, and the diffusion holes in the lower part of the high pressure side blade surface and in the upper part of the low pressure side blade surface are formed so as to open offset beneath the blades from the primary flow direction of high temperature gas along the axial direction of the turbine.

7. The cooling structure for a gas turbine according to claim 1, wherein the opening end of the diffusion holes has a funnel-shaped opening with a downstream side slope of the secondary flow which is less steeply sloped than an upstream side slope.

8. The cooling structure for a gas turbine according to claim 1, wherein the direction of the opening is within ±20° of the secondary flow direction having a different direction from the primary flow direction.

9. The cooling structure for a gas turbine according to claim 8, wherein the direction of the opening is within ±5° of the secondary flow direction.

* * * * *